US008450915B2

(12) United States Patent
Osawa et al.

(10) Patent No.: US 8,450,915 B2
(45) Date of Patent: May 28, 2013

(54) LED BULB AND LIGHTING APPARATUS

(75) Inventors: Shigeru Osawa, Yokohama (JP); Kazuto Morikawa, Yokosuka (JP); Toshiya Tanaka, Yokohama (JP); Takeshi Hisayasu, Ota-Ku (JP)

(73) Assignees: Toshiba Lighting & Technology Corporation, Yokosuka-shi, Kanagawa-ken (JP); Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/811,795

(22) PCT Filed: Dec. 24, 2008

(86) PCT No.: PCT/JP2008/073436
§ 371 (c)(1),
(2), (4) Date: Jul. 6, 2010

(87) PCT Pub. No.: WO2009/087897
PCT Pub. Date: Jul. 16, 2009

(65) Prior Publication Data

US 2010/0289396 A1 Nov. 18, 2010

(30) Foreign Application Priority Data

Jan. 7, 2008 (JP) ..... 2008-000268
May 19, 2008 (JP) ..... 2008-130747
Jul. 31, 2008 (JP) ..... 2008-199049

(51) Int. Cl.
*H01J 61/52* (2006.01)

(52) U.S. Cl.
USPC ..... 313/46; 362/294; 362/373

(58) Field of Classification Search
USPC ..... 313/46; 362/294, 373, 235
See application file for complete search history.

(56) References Cited

U.S. PATENT DOCUMENTS 1,972,790 A 9/1934 Olley
4,355,853 A 10/1982 Kourimsky (Continued)

FOREIGN PATENT DOCUMENTS

CN 101307887 11/2008
DE 10 2004 042186 3/2006

(Continued)

OTHER PUBLICATIONS

English Language Abstract of JP 2001-243809, published Sep. 7, 2001.

(Continued)

*Primary Examiner* — Anh Mai
*Assistant Examiner* — Elmito Breval
(74) *Attorney, Agent, or Firm* — Banner & Witcoff, Ltd.

(57) ABSTRACT

An object of the present invention is to provide an LED bulb in which temperature of a lighting circuit is suppressed from rising during lighting of an LED so that life time of the lighting circuit is maintained without increasing manufacturing cost of components. According to the invention, an LED module 11 having multiple LEDs surface-mounted thereon is mounted in a heat dissipating unit 12. Heat generated by the LEDs is dissipated through multiple heat dissipating fins 18 of the heat dissipating unit 12. A glove 14, covering the LED module 11, radiates outward radiant light from the LEDs. A lighting circuit 17 for lighting the LEDs is incorporated in an inner hollow portion 23 of a cap 16 arranged on a side opposite to the glove 14 of the heat dissipating unit 12. Accordingly, the heat generated by the LEDs of the LED module 11 is mostly dissipated by the heat dissipating unit 12, thereby suppressing the temperature of the lighting circuit from rising.

8 Claims, 10 Drawing Sheets

U.S. PATENT DOCUMENTS

| | | | | |
|---|---|---|---|---|
| 4,503,360 | A | 3/1985 | Bedel | |
| 4,630,182 | A | 12/1986 | Moroi | |
| D356,107 | S | 3/1995 | Watanabe et al. | |
| 5,537,301 | A | 7/1996 | Martich | |
| 5,556,584 | A | 9/1996 | Yamazaki | |
| 5,585,697 | A | 12/1996 | Cote | |
| 5,775,792 | A | 7/1998 | Wiese | |
| 5,785,418 | A | 7/1998 | Hochstein | |
| 5,857,767 | A | 1/1999 | Hochstein | |
| 5,947,588 | A | 9/1999 | Huang | |
| 6,095,668 | A | 8/2000 | Rykowski et al. | |
| 6,161,910 | A | 12/2000 | Reisenauer | |
| 6,294,973 | B1 | 9/2001 | Kimura | |
| 6,502,968 | B1 | 1/2003 | Simon | |
| 6,517,217 | B1 | 2/2003 | Liao | |
| 6,598,996 | B1 | 7/2003 | Lodhie | |
| 6,814,470 | B2 | 11/2004 | Rizkin et al. | |
| 6,936,855 | B1 | 8/2005 | Harrah | |
| 6,948,829 | B2 | 9/2005 | Verdes et al. | |
| 6,982,518 | B2 | 1/2006 | Chou et al. | |
| 7,059,748 | B2 | 6/2006 | Coushaine | |
| 7,074,104 | B2 | 7/2006 | Itaya | |
| 7,111,961 | B2 | 9/2006 | Trenchard | |
| 7,125,146 | B2 | 10/2006 | Willis | |
| D534,038 | S | 12/2006 | Kramer et al. | |
| 7,144,140 | B2 | 12/2006 | Sun et al. | |
| D534,665 | S | 1/2007 | Egawa et al. | |
| 7,198,387 | B1 | 4/2007 | Gloisten et al. | |
| 7,226,189 | B2 | 6/2007 | Lee et al. | |
| 7,300,173 | B2 | 11/2007 | Catalano | |
| 7,329,024 | B2 | 2/2008 | Lynch | |
| 7,331,689 | B2 | 2/2008 | Chen | |
| 7,347,589 | B2 | 3/2008 | Ge | |
| 7,431,477 | B2 | 10/2008 | Chou et al. | |
| 7,497,596 | B2 | 3/2009 | Ge | |
| 7,631,987 | B2 | 12/2009 | Wei | |
| 7,679,096 | B1 | 3/2010 | Ruffin | |
| 7,919,339 | B2 | 4/2011 | Hsu | |
| 7,947,596 | B2 | 5/2011 | Takeda | |
| 8,058,784 | B2 | 11/2011 | Treurniet | |
| 2002/0024814 | A1 | 2/2002 | Matsuba | |
| 2003/0117801 | A1 | 6/2003 | Lin | |
| 2003/0137838 | A1 | 7/2003 | Rizkin et al. | |
| 2003/0151917 | A1 | 8/2003 | Daughtry | |
| 2004/0109310 | A1 | 6/2004 | Galli | |
| 2004/0120156 | A1 | 6/2004 | Ryan | |
| 2004/0145898 | A1 | 7/2004 | Ase et al. | |
| 2004/0156191 | A1 | 8/2004 | Biasoli | |
| 2004/0218385 | A1 | 11/2004 | Tomiyoshi | |
| 2005/0007772 | A1 | 1/2005 | Yen | |
| 2005/0024864 | A1 | 2/2005 | Galli | |
| 2005/0068776 | A1 | 3/2005 | Ge | |
| 2005/0073244 | A1 | 4/2005 | Chou et al. | |
| 2005/0111234 | A1 | 5/2005 | Martin et al. | |
| 2005/0162864 | A1 | 7/2005 | Verdes et al. | |
| 2005/0174769 | A1 | 8/2005 | Yong | |
| 2005/0243552 | A1 | 11/2005 | Maxik | |
| 2006/0043546 | A1 | 3/2006 | Kraus | |
| 2006/0092640 | A1 | 5/2006 | Li | |
| 2006/0193130 | A1 | 8/2006 | Ishibashi | |
| 2006/0193139 | A1 | 8/2006 | Sun | |
| 2006/0198147 | A1 | 9/2006 | Ge | |
| 2006/0215408 | A1 | 9/2006 | Lee | |
| 2006/0227558 | A1* | 10/2006 | Osawa et al. | 362/351 |
| 2006/0239002 | A1 | 10/2006 | Chou et al. | |
| 2007/0002570 | A1 | 1/2007 | Souza | |
| 2007/0041182 | A1 | 2/2007 | Ge et al. | |
| 2007/0096114 | A1 | 5/2007 | Aoki | |
| 2007/0279903 | A1 | 12/2007 | Negley | |
| 2008/0037255 | A1 | 2/2008 | Wang | |
| 2008/0084701 | A1 | 4/2008 | Van De Ven | |
| 2008/0112170 | A1 | 5/2008 | Trott | |
| 2008/0130298 | A1 | 6/2008 | Negley | |
| 2008/0224608 | A1 | 9/2008 | Konishi | |
| 2009/0059595 | A1 | 3/2009 | Ge | |
| 2009/0116229 | A1 | 5/2009 | Dalton | |
| 2009/0116231 | A1 | 5/2009 | Miller | |
| 2009/0147670 | A1 | 6/2009 | Hu | |
| 2009/0161356 | A1 | 6/2009 | Negley | |
| 2009/0184646 | A1 | 7/2009 | Devaney | |
| 2009/0207602 | A1 | 8/2009 | Reed | |
| 2010/0026157 | A1 | 2/2010 | Tanaka | |
| 2010/0096992 | A1 | 4/2010 | Yamamoto | |
| 2010/0277082 | A1 | 11/2010 | Reed | |
| 2010/0289396 | A1 | 11/2010 | Osawa | |

FOREIGN PATENT DOCUMENTS

| | | |
|---|---|---|
| DE | 20 2008 016 231 | 4/2009 |
| EP | 1705421 | 9/2006 |
| EP | 2037633 | 3/2009 |
| EP | 2149742 | 2/2010 |
| JP | 57-152706 | 9/1982 |
| JP | 59-035303 | 2/1984 |
| JP | 61-35216 | 2/1986 |
| JP | 62-190366 | 12/1987 |
| JP | 63-5581 | 1/1988 |
| JP | 63-102265 | 5/1988 |
| JP | 64-7204 | 1/1989 |
| JP | 1-206505 | 8/1989 |
| JP | 2-91105 | 3/1990 |
| JP | 2000-083343 | 3/2000 |
| JP | 2000-173303 | 6/2000 |
| JP | 2001-243809 | 9/2001 |
| JP | 2002-525814 | 8/2002 |
| JP | 2002-280617 | 9/2002 |
| JP | 2003-016808 | 1/2003 |
| JP | 2003-059305 | 2/2003 |
| JP | 2003-59330 | 2/2003 |
| JP | 203-92022 | 3/2003 |
| JP | 2004-6096 | 1/2004 |
| JP | 2004-193053 | 7/2004 |
| JP | 2004-6096 | 8/2004 |
| JP | 2004-221042 | 8/2004 |
| JP | 2005-93097 | 4/2005 |
| JP | 2005-123200 | 5/2005 |
| JP | 2005-513815 | 5/2005 |
| JP | 2005-166578 | 6/2005 |
| JP | 2005-286267 | 10/2005 |
| JP | 2006-040727 | 2/2006 |
| JP | 3121916 | 5/2006 |
| JP | 2006-156187 | 6/2006 |
| JP | 2006-244725 | 9/2006 |
| JP | 2006-310057 | 11/2006 |
| JP | 2006-313717 | 11/2006 |
| JP | 2006-313718 | 11/2006 |
| JP | 2007-073306 | 3/2007 |
| JP | 2007-188832 | 7/2007 |
| JP | 2007-207576 | 8/2007 |
| JP | 2008-027910 | 2/2008 |
| JP | 2008-91140 | 4/2008 |
| JP | 2008-227412 | 9/2008 |
| JP | 2008-277561 | 11/2008 |
| JP | 2009-037995 | 2/2009 |
| JP | 2009-37995 | 2/2009 |
| JP | 2009-117342 | 5/2009 |
| JP | 2009-135026 | 6/2009 |
| JP | 2009-206104 | 8/2009 |
| WO | WO 03/056636 | 7/2003 |
| WO | WO 2005/024898 | 3/2005 |
| WO | WO 2008/146694 | 12/2008 |
| WO | WO 2009/087897 | 7/2009 |

OTHER PUBLICATIONS

English Language Abstract of JP Publication 01-206505 published Aug. 18, 1989.

English Language Abstract of JP Publication 2005-093097 published Apr. 7, 2005.

English Language Abstract of JP Publication 2005-123200 published May 12, 2005.

English Language Abstract of JP 2006-313718, published Nov. 16, 2006.

English Language Abstract of JP Publication 63-005581 published Jan. 11, 1988.

English Language Abstract of JP Publication 64-007402 published Jan. 11, 1989.

English Language Machine Translation of JP 2000-083343, published Mar. 21, 2000.
English Language Machine Translation of JP 2000-173303 published Jun. 23, 2000.
English Language Machine Translation of JP 2001-243809, published Sep. 7, 2001.
Enitlish Language Machine translation of JP 2003-59330 published Feb. 28, 2003.
English Language Machine Translation of JP 2004-006096 published Jan. 8, 2004.
English Language Machine Translation of JP 2004-193053 published Jul. 8, 2004.
English Language Machine Translation of JP 2005-166578 published Jun. 23, 2005.
English Language Machine translation of JP 2005-513815 published May 12, 2005.
English Language Machine translation of JP 2006-040727 published Feb. 9, 2006.
English Language Machine Translation of JP 2006-310057, published Nov. 9, 2006.
English Language Machine Translation of JP 2006-313718, published Nov. 16, 2006.
English Language Machine translation of JP 2008-91140 published Apr. 17, 2008.
English Language Machine Translation of JP 2009-37995, published Feb. 19, 2009.
English Language Machine Translation of JP 3121916, published May 10, 2006.
English Language Machine Translation of JP Publication 2005-093097 published Apr. 7, 2005.
English Language Machine Translation of JP Publication 2005-123200.
English Language Machine translation of JP-2002-280617published Sep. 27, 2002.
English Language Machine translation of JP-2005-286267 published Oct. 13, 2005.
English Language Machine translation of JP-2006-244725 published Sep. 14, 2006.
English Language Machine Translation ofJP 2003-092022 published Mar. 28, 2003.
English Language Translation of Office Action issued in corresponding Japanese Appl 2005-221571 on Oct. 20, 2009.
English Language Translation of International Search Report for PCT/JP2008/073436 mailed Mar. 24, 2009.
English translation of Office Action issued in corresponding Japanese Appl 2005-221571 on Jul. 7, 2009.
English translation of Office Action issued in corresponding Japanese Appl 2005-221571 on Aug. 25, 2009.
English Language Translation of Office Action issued in Japanese Appl 2005-221688 on Jan. 26, 2010.
Machine English language translation of JP-2003-016808 published Jan. 17, 2003.
Office Action issued in corresponding Japanese Appl 2005-221571 on Jul. 7, 2009.
Office Action issued in corresponding Japanese Appl 2005-221571 on Aug. 25, 2009.
Office Action issued in corresponding Japanese Appl 2005-221571 on Oct. 20, 2009.
Search Report of International Application No. PCT/JP2008/068625 mailed Dec. 9, 2008.
English Language Abstract of JP 2004-193053 published Jul. 8, 2004.
English Language Abstract of JP 2-91105 published Mar. 30, 1990.
English Language Abstract of JP 2000-173303 published Jun. 23, 2000.
English Language Abstract of JP 2003-092022 published Mar. 28, 2003
English language abstract of JP-2002-280617 published Sep. 27, 2002.
English language abstract of JP-2003-016808 published Jan. 17, 2003.
Ehglish Language Abstract of 2003-59330 published Feb. 28, 2003.
English Language Abstract of JP 2005-166578 published Jun. 23, 2005.
English language abstract of JP-2005-286267 published Oct. 13, 2005.
English Language Abstract of JP 2006-040727 published Feb. 9, 2006.
English language abstract of JP-2006-244725 published Sep. 14, 2006.
English Language Abstract of JP 2008-91140 published Apr. 17, 2008.
English Language Abstract of JP 2004-006096 published Jan. 8, 2004.
Office Action issued in Japanese Appl 2005-221688 on Jan. 26, 2010.
English Language Abstract of JP 2009-37995, published Feb. 19, 2009.
English Language Abstract of JP 2000-083343, published Mar. 21, 2000.
English Language Abstract of JP 57-152706 published Sep. 21, 1982.
English Language Abstract of JP 2006-310057, published Nov. 9, 2006.
International Preliminary Report on Patentability and Written Opinion issued in PCT/JP2008/068625 mailed May 11, 2010.
Office Action issued in Japanese Appl 2005-371406 on Apr. 20, 2010.
English Translation of Office Action issued in Japanese Appl 2005-371406 on Apr. 20, 2010.
U.S. Appl. No. 12/825,650.
U.S. Appl. No. 12/794,379.
U.S. Appl. No. 12/794,429.
U.S. Appl. No. 12/794,509.
U.S. Appl. No. 12/794,558.
U.S. Appl. No. 12/811,795.
U.S. Appl. No. 12/738,081.
U.S. Appl. No. 12/713,230.
U.S. Appl. No. 12/825,956.
Japanese Office Action issued in JP 2008-198625 on May 26, 2010.
English Translation of Japanese Office Action issued in JP 2008-198625 on May 26, 2010.
Amendment filed in JP 2008-198625 on Jun. 28, 2010.
English Translation of Amendment filed in JP 2008-198625 on Jun. 28, 2010.
English Language Abstract of JP 2006-313717 published Nov. 16, 2006.
Machine English Translation of JP 2006-313717 published Nov. 16, 2006.
English Language Abstract of JP 2009-135026 published Jun. 18, 2009.
English Language Translation of JP 2009-135026 published Jun. 18, 2009.
English Language Abstract of JP 2002-525814 published Aug. 13, 2002.
English Language Abstract of JP 2003-059305 published Feb. 28, 2003.
English Language Translation of JP 2003-059305 published Feb. 28, 2003.
English Language Abstract of JP 2009-037995 published Feb. 19, 2009.
English Language Translation of JP 2009-037995 published Feb. 19, 2009.
English Language Abstract of JP 2007-188832 published Jul. 26, 2007.
English Language Translation of JP 2007-188832 published Jul. 26, 2007.
English Language Abstract of JP 2008-027910 published Feb. 7, 2008.
English Language Translation of JP 2008-027910 published Feb. 7, 2010.
English Language Abstract of JP 2007-207576 published Aug. 16, 2007.
English Language Translation of JP 2007-207576 published Aug. 16, 2007.
English Language Abstract of JP 2007-073306 published Mar. 22, 2007.

English Language Translation of JP 2007-073306 published Mar. 22, 2007.
U.S. Appl. No. 12/880,490.
U.S. Appl. No. 12/845,330.
U.S. Appl. No. 12/933,969.
U.S. Appl. No. 12/885,849.
U.S. Appl. No. 12/886,025.
U.S. Appl. No. 12/886,123.
U.S. Appl. No. 11/399,492 (now U.S. Patent 7,758,223).
Extended European Search Report issued in EP Appl 10006720.6 on Oct. 13, 2010.
English Language Abstract of JP 61-35216 published Feb. 2, 1086.
IPRP & WO issued in PCT/JP2008/073436 on Aug. 10, 2010.
Extended European Search Report issued in EP 111560003.9 on May 18, 2011.
Extended European Search Report issued in EP 08838942.4 on Jun. 1, 2011.
English Language Abstract of JP 2008-277561 published on Nov. 13, 2008.
English Language Translation of JP 2008-277561 published on Nov. 13, 2008.
English Language Abstract of JP 2008-227412 published Sep. 25, 2008.
English Language Translation of JP 2008-227412 published Sep. 25, 2008.
Japanese Office Action issued in 2005-269017 on Jan. 13, 2011.
English Language Translation of Japanese Office Action issued in 2005-269017 on Jan. 13, 2011.
English Language Abstract of JP 2004-221042 published Aug. 5, 2004.
English Language Translation of JP 2004-221042 published Aug. 5, 2004.
English Language Abstract of JP 63-102265 published May 7, 1988.
English Language Abstract of JP 2009-206104 published Sep. 10, 2009.
English Language Translation of JP 2009-206104 published Sep. 10, 2009.
European Search Report issued in EP 10178361.1 on Jul. 4, 2011.
U.S. Appl. No. 13/172,557.
U.S. Appl. No. 13/221,519.
U.S. Appl. No. 13/221,551.
English Language Translation of JP 2002-525814 published Aug. 13, 2002.
English Language Abstract of JP 2006-156187 published Jun. 15, 2006.
English Language Translation of JP 2006-156187 published Jun. 15, 2006.
U.S. Appl. No. 13/044,369.
U.S. Appl. No. 12/888,921.
U.S. Appl. No. 13/034,959.
U.S. Appl. No. 12/885,005.
U.S. Appl. No. 12/794,476.
International Search Report issued in EP 07721252 on Sep. 23, 2011.
Huwaei: "One Solution to Error Indication of SGSN controlled bearer optimization", 3GPP Draft; S2-062756, 3rd Generation Partnership Project (3GPP), Mobile Competence Centre; 650, Route Des Lucioles; F-06921 Sophia-Antipolis Cedex; France, vol. SA WG2, No. Sophia; Aug. 18, 2006.
"One Tunnel Functional Description (Release 7)", Sep. 2006, retrieved from the Internet:URL:http://www.3gpp.org/ftp/Specs/archive/23__series23.809/23809-100.zip.
Nokia: Change Request: Direct Tunnel Functionality, Oct. 23, 2006, Retrieved from the Internet: URL:http://www.3gpp.org/ftp/tsg__sa/WG2__Arch/TSGS2__55__Besan/Docs/S2-063918.zi.
Chinese Office Action issued in CN 201010216943 on Oct. 26, 2011.
English Language Translation of Chinese Office Action issued in CN 201010216943 on Oct. 26, 2011.
English Language Abstract CN 101307887 published Nov. 19, 2008.
Related U.S. Appl. No. 12/794,379.
Related U.S. Appl. No. 12/794,429.
Related U.S. Appl. No. 12/794,476.
Related U.S. Appl. No. 12/794,509.
Related U.S. Appl. No. 12/738,081.
Related U.S. Appl. No. 12/880,490.
Related U.S. Appl. No. 12/885,005.
Related U.S. Appl. No. 12/933,969.
Related U.S. Appl. No. 12/886,123.
English Language Translation of JP 2009/117342 published May 28, 2009.
English Language Abstract of JP 2009/117342 published May 28, 2009.
Related U.S. Appl. No. 12/886,025.
Related U.S. Appl. No. 13/044,369.
Related U.S. Appl. No. 13/221,519.

* cited by examiner

LED BULB AND LIGHTING APPARATUS

TECHNICAL FIELD

The present invention relates to an LED bulb which emits radiant light outward from an LED and also relates to a lighting apparatus equipped with the LED bulb.

BACKGROUND ART

There is known an LED (electric) bulb in which an LED (light emitting diode) module serving as a lighting source is covered with a glove so as to provide an outer appearance of a filament bulb. For the LED, as a temperature thereof rises, an optical output becomes reduced and a life time is also shortened, so that it is required, for a lamp using an LED as the light source, to suppress the temperature of the LED from rising.

Thus, there has been provided a known LED bulb in which heat dissipation characteristics of the LED could be improved without increasing the manufacturing cost (for example, refer to Patent Document 1). According to Patent Document 1, a printed circuit board having an LED mounted thereon is contained in a metal body having a plurality of heat dissipating fins so that the LED is mounted on the printed circuit board to be close to an internal surface of the body, thereby allowing the heat dissipating fins of the body to dissipate the heat of the LED.

Further, a power source circuit (lighting circuit) generating an electric power for the LED is mounted and formed in another printed circuit board arranged separately from the above-mentioned printed circuit board to be disposed in an inner hollow portion of the body.

Patent Document 1: Japanese Patent Laid-Open No. 2006-40727

DISCLOSURE OF THE INVENTION

According to Patent Document 1, however, since the lighting circuit is accommodated inside the apparatus body, when heat generated by the LED is dissipated through the heat dissipating fin to an external atmosphere, the heat is also transmitted to the lighting circuit included in the heat dissipating unit. Accordingly, the temperature of components of the lighting circuit rises during the lighting (glowing) time of the LED, and hence, the life of the lighting circuit is significantly shortened. On the other hand, in order to maintain the usable life of the lighting circuit, it becomes necessary to use components having a higher heat tolerance, which results in increasing in manufacturing cost.

An object of the present invention is to provide an LED bulb and a lighting apparatus in which the temperature of a lighting circuit is suppressed from rising during the lighting of an LED so as to preferably maintain life of the lighting circuit without increasing cost of components.

An LED bulb according to the present invention includes: an LED module having a plurality of LEDs surface-mounted thereon; a heat dissipating unit having the LED module mounted thereon and dissipating heat generated by the LEDs through a plurality of heat dissipating fins; a glove covering the LED module and radiating radiant light from the LEDs to the outside; a cap arranged on a side opposite to the glove of the heat dissipating unit and having an inner hollow portion; and a lighting circuit incorporated in the inner hollow portion of the cap so as to light the LEDs.

In the present invention and the following invention, the definition and technical meaning of terms used therein are as follows. A term "LED module" refers to a light source unit in which a plurality of LEDs are surface-mounted or mounted on a surface of a substrate in the shape of flat plate. The LED module is arranged so that one surface side having the LEDs surface-mounted thereon is directed outward and another surface side of the LED module is disposed in the heat dissipating unit.

A heat dissipating unit is a unit for dissipating heat generated by the LEDs, is made of a metal member having excellent heat, conductivity, for example, and is provided with a heat dissipating fin. A glove covering the LED module radiates radiant light from the LEDs to the outside.

A cap is arranged on a side opposite to the glove of the heat dissipating unit. A lighting circuit for lighting the LEDs is arranged in an inner hollow portion of the cap and electrically connected to the cap.

According to the present invention, the lighting circuit is arranged in the inner hollow portion of the cap, so that a distance between the LED module and the lighting circuit is set longer, and accordingly, the heat of the LED module is mostly dissipated through the heat dissipating unit. Thus, the temperature of the lighting circuit is suppressed from rising and the life time of the lighting circuit can be elongated, leading the reduction of manufacturing cost.

In the above invention, it may be desired that the LED module is disposed on the glove side of the heat dissipating unit in a manner contacting a surface portion of the heat dissipating unit, and the heat dissipating unit is formed with a line-through-hole having a size sufficient for allowing at least a line extending from the LED module and connected to the lighting circuit to pass through this hole.

Herein, the expression "disposed in a manner contacting with the heat dissipating unit" means that a contact area therebetween is enlarged in the arrangement so that heat generated by the LEDs of the LED module is readily transmitted to the heat dissipating unit. An insulating material is disposed in the line-through-hole of the heat dissipating unit so as to arrange the line. The expression "a size sufficient for allowing a line to pass through the hole" means a size which ensures insulation between the line and the heat dissipating unit.

According to this structure, the lighting circuit is disposed in the inner hollow portion of the cap, and accordingly, the hollow of the heat dissipating unit can be formed with the line-through-hole having the size sufficient for allowing a line connecting the LED module and the lighting circuit to pass through the hole. Accordingly, the heat dissipating area of the heat dissipating unit can be enlarged to thereby improve the heat dissipation efficiency of the heat dissipating unit.

In the above invention, it may be desired that the heat dissipating fins are formed so as to extend externally in a radial pattern from the center of the heat dissipating unit, and the heat dissipating unit has a portion adjoining the heat dissipating fins having a convex shape projecting on the cap side toward the center of the heat dissipating.

Herein, the expression "the heat dissipating fins extend externally in a radial pattern from the center of the heat dissipating unit" means that the heat dissipating fins, arranged in the central part of the heat dissipating unit, are arranged so as to extend externally in a radial pattern from the base end of the heat dissipating fin on the central axis side of the heat dissipating unit.

The expression "a portion of the heat dissipating unit adjoining the heat dissipating fin" means a portion on the side of a heat dissipating plate on which the LED module is mounted in a contacted manner. The expression "a convex shape projecting in a direction of the cap" means a substantially pyramidal configuration in which the central portion gradually protrudes in a direction of the cap.

In this way, the heat dissipating fins are formed so as to extend externally in a radial pattern from the center of the heat dissipating unit, and the heat dissipating unit having a portion adjoining the heat dissipating fin so as to provide a convex shape projecting on the cap side toward the center of the heat dissipating unit. Thus, the flow of air circulating through the heat dissipating fins becomes smoother, thus improving the heat dissipation efficiency.

In the above invention, it may be desired that an insulating unit having an inner hollow portion is arranged between the heat dissipating unit and the cap, and a groove, with which an end of the heat dissipating fin is engaged, is formed in a tip end of the insulating unit.

Herein, the expression "insulating unit" means a member for ensuring insulation between the heat dissipating unit and the cap. The end of the heat dissipating fin of the heat dissipating unit is inserted and fitted (seized) in the groove, whereby the heat dissipating unit and the insulating unit are joined.

In this way, the insulating performance can be ensured by the insulating unit between the heat dissipating unit and the cap. Furthermore, since the end of the heat dissipating fin is engaged with the groove of the insulating unit, torsion strength is ensured between the heat dissipating unit and the insulating unit. Accordingly, when the LED bulb is attached to a socket, satisfactory torsion strength can be ensured.

Still furthermore, in the above invention, it may be desired that the tip end of the insulating unit is fitted into the heat dissipating unit, and a base end of the heat dissipating fin on a central axis side of the heat dissipating unit exists closer to the central axis side than a portion having a maximum outer diameter of the insulating unit.

Herein, the expression "a tip end of the insulating unit is fitted into the heat dissipating unit" means that the insulating unit is arranged between the heat dissipating unit having the LED module mounted thereon and the cap having the lighting circuit incorporated therein, and the tip end of the insulating unit is fitted into the heat dissipating unit on the side of the cap, whereby the heat dissipating unit and the cap are attached to each other through the insulating unit. In this way, the LED module, the heat dissipating unit, the insulating unit and the cap are arranged in this order, and accordingly, the heat dissipation for the LED module is performed by the heat dissipating unit, and the heat dissipation for the lighting circuit is performed by the cap, thereby entirely improving the heat dissipation characteristics.

The expression "a base end of the heat dissipating fin on a central axis side of the heat dissipating unit" refers to an elementary portion of the heat dissipating fin planted around the central axis of the heat dissipating unit. The expression "a base end of the heat dissipating fin is closer to the central axis side than a portion having a maximum outer diameter of the insulating unit" means that the base end of the heat dissipating fin is disposed on the central axis side relative to the portion having a maximum outer diameter of the insulating unit.

According to such structure, the tip end of the insulating unit is inserted inside of the heat dissipating unit, and the base end of the heat dissipating fin on the central axis side of the heat dissipating unit exists closer to the central axis side than the portion of the maximum outer diameter of the insulating unit. Accordingly, the surface area of the heat dissipating fin can be enlarged, and the heat dissipation effects can be improved.

In the above invention, it may be desired that a reflecting plate for reflecting, in a direction of the glove, light radiated from the glove in a direction of the heat dissipating unit is arranged to a junction portion between the heat dissipating unit and the glove.

Herein, the expression "light radiated from the glove in a direction of the heat dissipating unit" refers to the light diffused by the glove and passing toward the rear side of the glove (in a direction of the heat dissipating unit). It may be preferred to use, as the reflecting plate, for example, a white reflecting plate, a reflecting plate plated with aluminum or chromium, or a reflecting plate evaporated with aluminum.

In this way, the reflecting plate is arranged to the junction portion between the heat dissipating unit and the glove, whereby the light diffused and passing toward the rear side is returned to the side surface of the glove or the glove front side, and accordingly, the light loss is reduced, leading the improved device efficiency.

Furthermore, in the above invention, it may be desired that a constricted portion is formed to the junction portion between the heat dissipating unit and the glove.

Herein, the term "constricted portion" refers to a concave portion formed by decreasing the heat dissipating unit and the glove at the junction portion therebetween so as to reduce a diameter at the junction portion than the portion having a maximum outer diameter.

According to this structure, since the constricted portion is provided to the junction portion between the heat dissipating unit and the glove, the distribution of light can be improved in the side surface and the rear side of the glove.

A lighting apparatus according to the present invention includes the LED bulb according to the above invention and a lighting apparatus body having a socket to which the LED bulb is mounted.

According to the present invention, the lighting apparatus having the effects mentioned above may be provided.

BEST MODE FOR CARRYING OUT THE INVENTION

Figure 1:
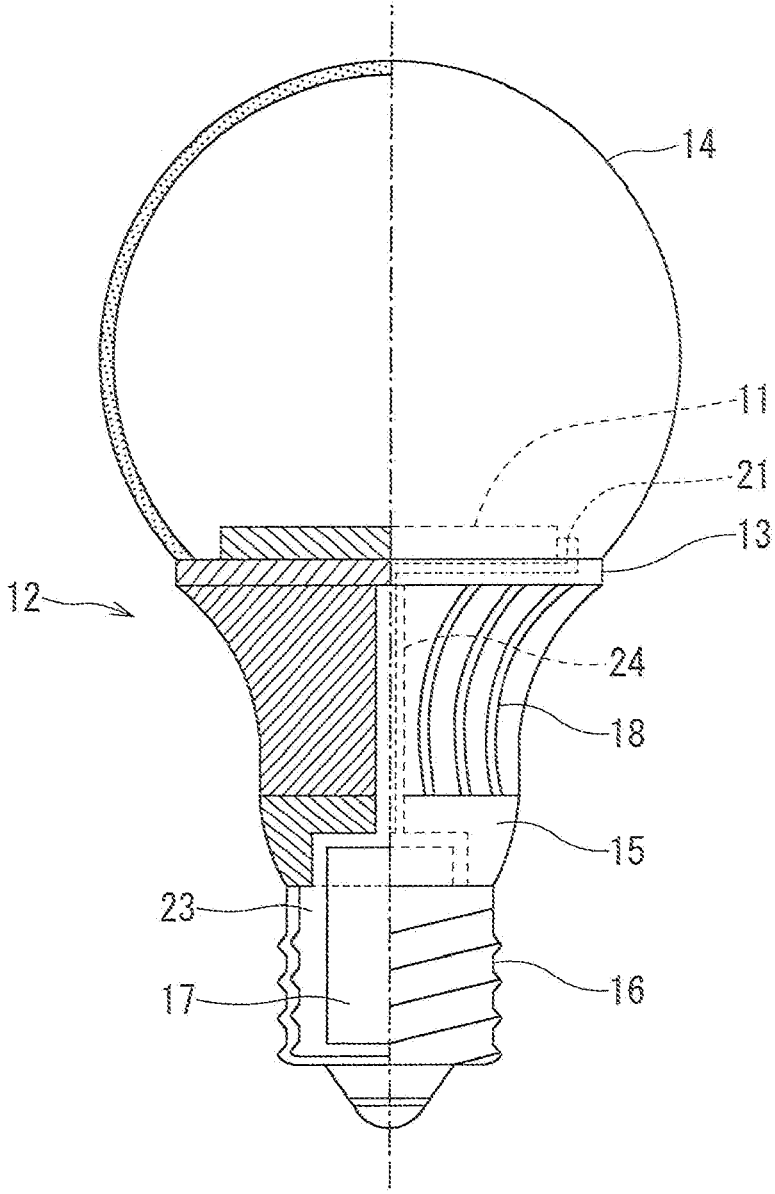
FIG. 1 is a front view of an LED bulb according to a first embodiment of the present invention.

FIG. 1 is a front view of an LED bulb according to a first embodiment of the present invention, in which a left half side is shown in section. An LED module 11 having a plurality of LEDs (surface-mounted thereon) is mounted on a heat dissipating (radiating) plate 13 of a heat dissipating (radiating)

unit 12 in a manner contacting the heat dissipating plate 13. A glove 14 is mounted in the heat dissipating plate 13 of the heat dissipating unit 12 so as to cover the LED module 11, and a and radiant light from the LEDs of the LED module 11 is externally radiated through the glove.

A cap 16 is mounted via an insulating member 15 made of synthetic resin on a side opposite to the glove 14 of the heat dissipating unit 12. The cap 16 has an inner hollow portion, and a lighting circuit 17 for lighting (glowing) the LEDs is incorporated in an inner hollow portion 23 of the cap 16.

In the heat dissipating unit 12, the LED module 11 is, as described above, mounted on the heat dissipating plate 13, and a plurality of heat dissipating fins 18 are arranged on the side surface of the heat dissipating unit 12 so as to extend in a radial pattern outward from the center of the heat dissipating unit 12. Heat generated by the LEDs of the LED module 11 is transmitted through the heat dissipating plate 13 to the plurality of heat dissipating fins 18 and dissipated through the plurality of heat dissipating fins 18.

Figure 2:
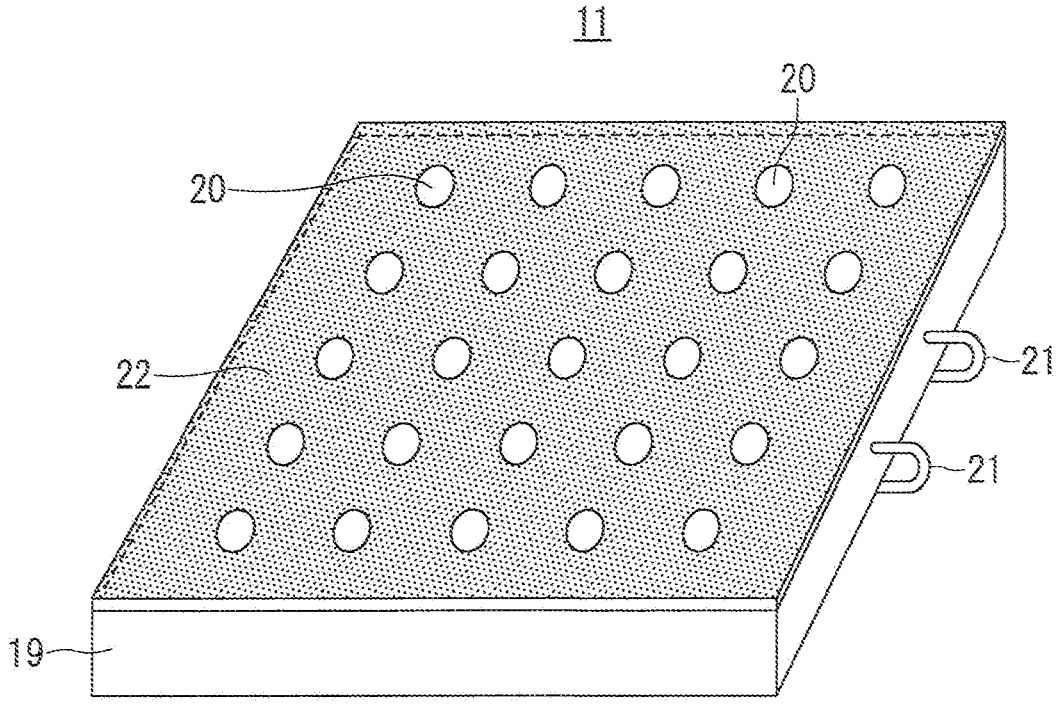
FIG. 2 is a perspective view of an LED module according to the first embodiment of the present invention.

FIG. 2 is a perspective view of the LED module 11. In the LED module 11, a plurality of LEDs 20 are mounted (surface-mounted) on a surface of a substrate 19 having a rectangular solid body in a shape of flat plate, and a line 21 is extracted from the side surface of the LED module 11. For example, in a case where the LED 20 is a blue LED, a light from the blue LED is radiated through a yellow fluorescent material 22 so as to obtain a white light. The LED module 11 is disposed in the heat dissipating plate 13 of the heat dissipating unit 12 so that the surface of the LED module 11 on which the LEDs are mounted faces the side of the glove 14.

The LED 20 may be of a COB-type in which a chip-shaped element is mounted on a mount portion of the substrate 19 and bonded thereto by a lead wire, or may be of a SMD-type in which a package component as an LED element with lead terminals is mounted on a land.

The heat dissipating unit 12 is made of a metal such as copper (Cu), aluminum (Al) or iron (Fe), or alloy composed of these metals. The heat dissipating plate 13 and the heat dissipating fin 18 are integrally formed or connected to each other in a manner to be conductive. In the heat dissipating plate 13 of the heat dissipating unit 12, a groove is formed to pass the line 21 of the LED module 11 therethrough. The LED module 11 is arranged on the heat dissipating plate 13 of the heat dissipating unit 12 on the side of the glove 14 in a manner contacting the heat dissipating plate 13. However, the line 21 of the LED module 11 is arranged in the groove of the heat dissipating plate 13.

A line-through-hole 24 of the heat dissipating unit 12 is formed in the central portion of the heat dissipating plate 13, and the line 21 of the LED module 11 pass through the line-through-hole 24 and is connected to the lighting circuit 17 disposed in the inner hollow portion 23 of the cap 16. With the lighting circuit 17 disposed in the hollow portion 23 of the cap 16, the line-through-hole 24 of the heat dissipating unit 12 has a size sufficient for allowing the line 21 for connecting the LED module 11 and the lighting circuit 17 to pass through the hole. In this case, an insulating material is provided on an inner peripheral surface of the line-through-hole 24 so as to ensure insulation between the line 21 and the heat dissipating unit 12.

Accordingly, the contact area between the LED module 11 and the heat dissipating plate 13 of the heat dissipating unit 12 becomes enlarged, and hence, the heat dissipation efficiency can be improved. Further, the size or dimension of the heat dissipating fin 18 can be also made large, it becomes possible to further improve the heat dissipation efficiency.

Heat generated by the LEDs of the LED module 11 tends to accumulate exclusively to the central portion of the LED module 11. Therefore, as in a conventional case, when the line-through-hole 24 of the heat dissipating unit 12 is greater in a size or dimension, the central portion of the LED module 11, at which the heat generated by the LEDs is concentrated, is positioned so as to accord with the line-through-hole 24 of the heat dissipating unit 12, and accordingly, the heat dissipation efficiency was not good.

According to the first embodiment of the present invention, however, the line-through-hole 24 of the heat dissipating unit 12 has a size sufficient for allowing the line 21 for connecting the LED module 11 and the lighting circuit 17 to pass through the hole 24, and therefore, the line-through-hole 24 of the heat dissipating unit 12 can be made smaller in size, thereby improving the heat dissipation efficiency.

Further, the heat dissipating unit 12 is separated from the cap 16 by the insulating unit 15, and accordingly, the heat generated by the LEDs hardly passes through the heat dissipating fins 18 of the heat dissipating unit 12 and is hardly transmitted to the cap 16. Thus, the heat generated by the LEDs is prevented from being transmitted to the lighting circuit 17 arranged in the hollow portion 23 of the cap 16.

According to the first embodiment of the present invention, since the lighting circuit 17 is arranged in the hollow portion 23 of the cap 16, the distance between the LED module 11 and the lighting circuit 17 is set to be longer and the heat dissipating unit 12 and the cap 16 are separated by the insulating unit 15, substantially the almost all the heat generated by the LEDs of the LED module 11 can be dissipated by the heat dissipating unit 12, thus suppressing the temperature of the lighting circuit from rising. Accordingly, the life of the lighting circuit is prolonged, and the cost to be required for lamp replacement can be reduced.

Furthermore, since the lighting circuit 17 is arranged in the inner hollow portion 23 of the cap 16, it can be possible for the hollow portion 23 to have a small size capable of allowing the line 21 for connecting the LED module 11 and the lighting circuit 17 to pass through the hole 23, and accordingly, the heat dissipating (radiating) area of the heat dissipating unit 12 can be made large, thus improving the heat dissipation efficiency of the central portion of the LED module 11 in which the heat generated by the LEDs intends to be concentrated.

Figure 3:
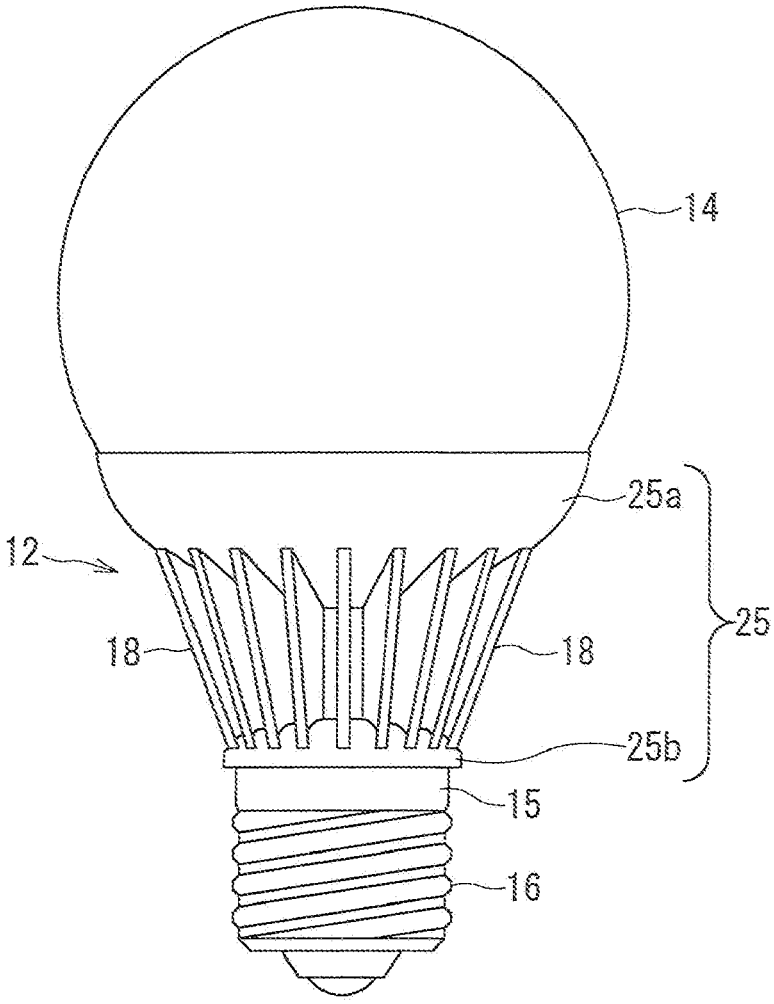
FIG. 3 is a front view of an LED bulb according to a second embodiment of the present invention.

FIG. 3 is a front view of an LED bulb according to a second embodiment of the present invention. The difference of the second embodiment from the first embodiment illustrated in FIG. 1 resides in the configuration of the heat dissipating unit 12 and the insulating unit 15.

More specifically, the outer configuration of a support portion or unit 25, which constitutes the heat dissipating plate 13 of the heat dissipating unit 12, to which the LED module 11 is connected and supported, provides a pan lid shape (or pan bottom shape) gradually projecting in a direction toward the base as the outer shape of the support portion 25 is being directed toward the central portion of the heat dissipating unit 12.

On the other hand, the upper surface configuration of the insulating unit 15 is formed so as to provide a pan lid shape (or pan bottom shape) gradually projecting in a direction of the glove 14 toward the center portion of the heat dissipating unit 12.

Further, like reference numerals are added to portions or members corresponding to those of FIG. 1, and repeated explanation thereof is omitted herein.

More specifically, the outer circumferential surface of the support portion 25 of the heat dissipating unit 12 is formed so as to have a substantially hemispheric configuration so as to provide a circular-arc shape at a boundary portion with respect to the heat dissipating fin 18. As seen from the side of the glove 14 of the heat dissipating unit 12, the support portion 25 has a substantially cone-shaped configuration in which the central portion thereof gradually projects in a direction of the cap 16.

The upper surface of the insulating unit 15 is formed so as to provide a substantially hemispheric configuration, so that the boundary portion with the heat dissipating fin 18 provides an arc-shaped configuration as seen from the side of the cap 16 (the side of the insulating unit 15) of the heat dissipating unit 12, and a substantially cone-shaped configuration is provided so as to gradually project toward the central part in a direction of the glove 14 gradually increases.

Figure 4:
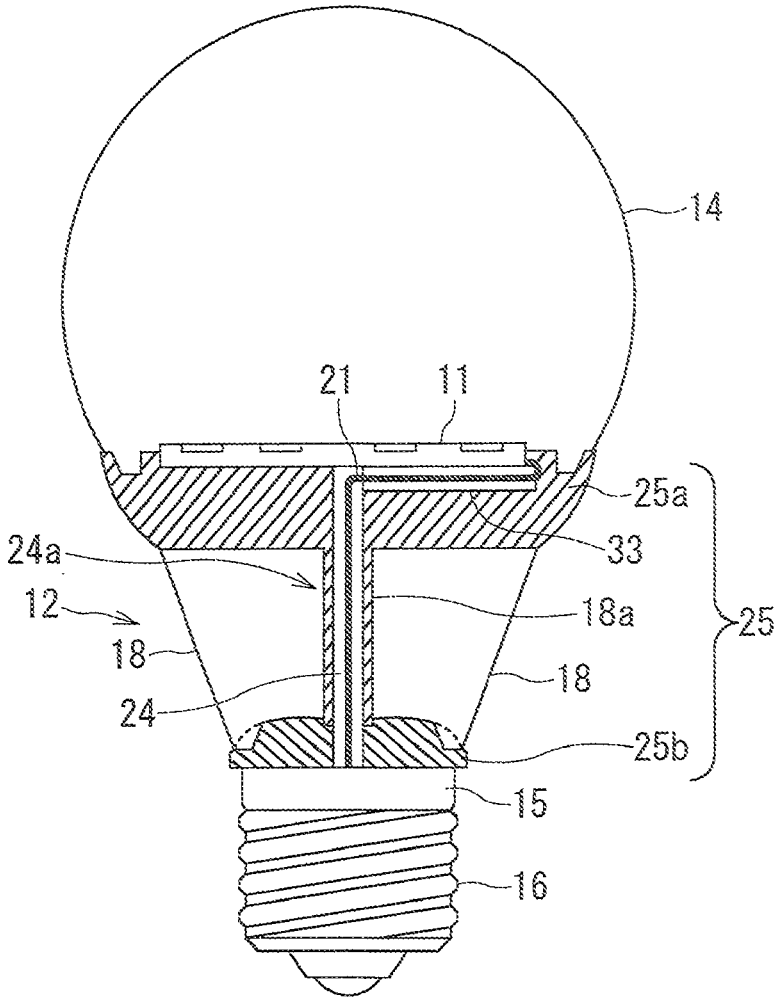
FIG. 4 is a cross-sectional view of the LED bulb according to the second embodiment of the present invention.

FIG. 4 is a sectional view of the LED bulb according to the second embodiment of the present invention. A line groove 33 through which the line 21 of the LED module 11 passes is formed in the support portion 25 on the side of the glove 14 of the heat dissipating unit 12. As like as the first embodiment illustrated in FIG. 1, the line 21 of the LED module 11 passes through the line-through-hole 24 formed in the central portion of the heat dissipating unit 12 and is connected to the lighting circuit 17 arranged in the inner hollow portion 23 of the cap 16.

A hollow columnar line tube 24*a* in which the line-through-hole 24 is formed is arranged in the central shaft of the heat dissipating unit 12, and the heat dissipating fins 18 extend in a radial pattern from the line tube 24*a* via a base end 18*a*.

Figure 5A:
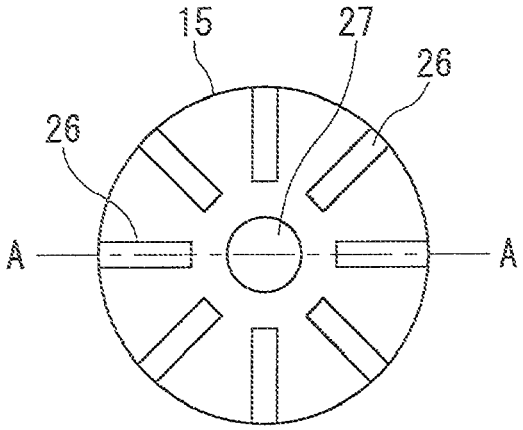
FIGS. 5A and 5B show illustrations of a structure of a pan lid-shaped portion formed in an insulating unit according to the second embodiment of the present invention.
Figure 5B:
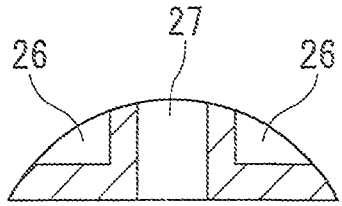

FIG. 5 is a structural diagram of the insulating unit 15, in which FIG. 5(*a*) is a top plan view of the insulating unit 15, and FIG. 5(*b*) is a sectional view, partially in an enlarged scale, taken along the line A-A of FIG. 5(*a*).

The insulating unit 15 is formed with a groove 26 for engaging an end of the heat dissipating fin 18. The end of the heat dissipating fin 18 of the heat dissipating unit 12 is inserted in the groove 26 so as to be engaged or seized with the end of the heat dissipating fin 18.

A line-through-hole 27 communicating with the line-through-hole 24 of the heat dissipating unit 12 is formed in the central portion of the insulating unit 15. The line of the LED module 11 inserted into the line-through-hole 24 of the heat dissipating unit 12 is connected to the lighting circuit arranged in the hollow portion of the cap 16.

The LED module 11 having a plurality of LEDs surface-mounted thereon is mounted in a manner contacting the surface of the heat dissipating plate formed inside the support portion 25 of the heat dissipating unit 12. This is the same structure as that of the first embodiment in which the heat dissipating plate 13 is formed integrally with the heat dissipating unit 12. The heat generated by the LED of the LED module 11 is transmitted from the support portion 25 of the heat dissipating unit 12 to a plurality of heat dissipating fins 18 and then dissipated therefrom.

According to the second embodiment, the insulating unit 15 and the support portion 25 adjoining the heat dissipating fin 18 have a substantially cone-shaped configuration gradually projecting in a direction of the central portion. Accordingly, air circulating through the heat dissipating fin 18 readily enters the inside of the heat dissipating unit 12, and the air smoothly flows, thus improving the heat dissipation effects.

Further, a groove for arranging the line 21 of the LED module 11 is formed in the support portion 25 of the heat dissipating unit 12. Accordingly, the thickness of the support portion 25 is greater than that of the heat dissipating plate 13 of the first embodiment. Thus, the groove for arranging the line 21 of the LED module 11 can be easily formed. Furthermore, the end, on the side of the cap 16, of the heat dissipating fin 18 is engaged with the groove 26 of the insulating unit 15, so that the torsion strength is ensured between the heat dissipating unit 12 and the insulating unit 15, thus satisfactorily ensuring the torsion strength when the LED bulb is attached to a socket.

Figure 6:
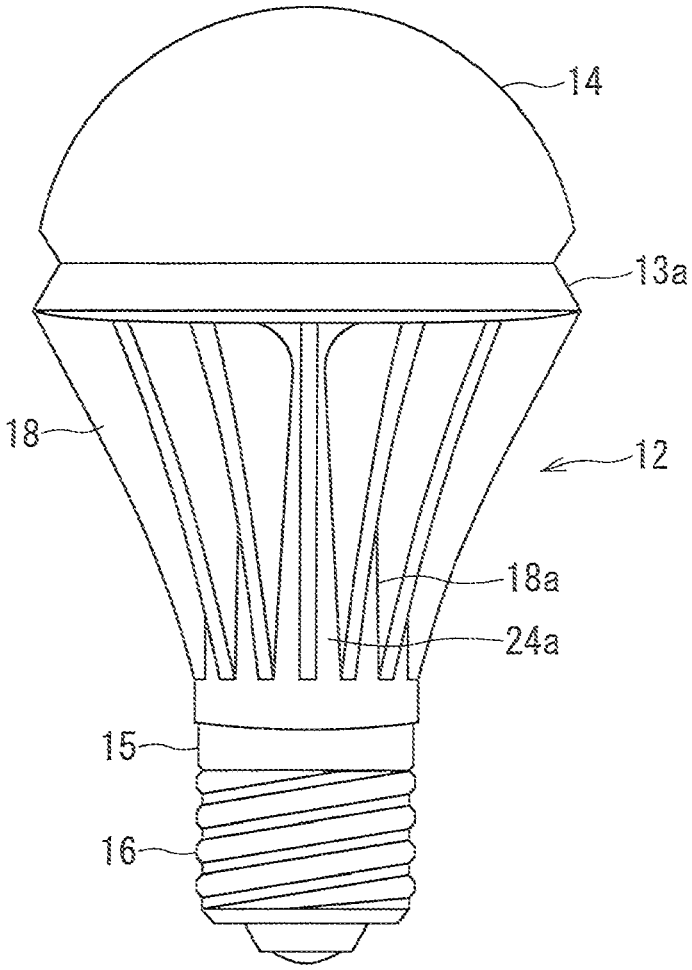
FIG. 6 is a front view of an LED bulb according to a third embodiment of the present invention.
Figure 7:
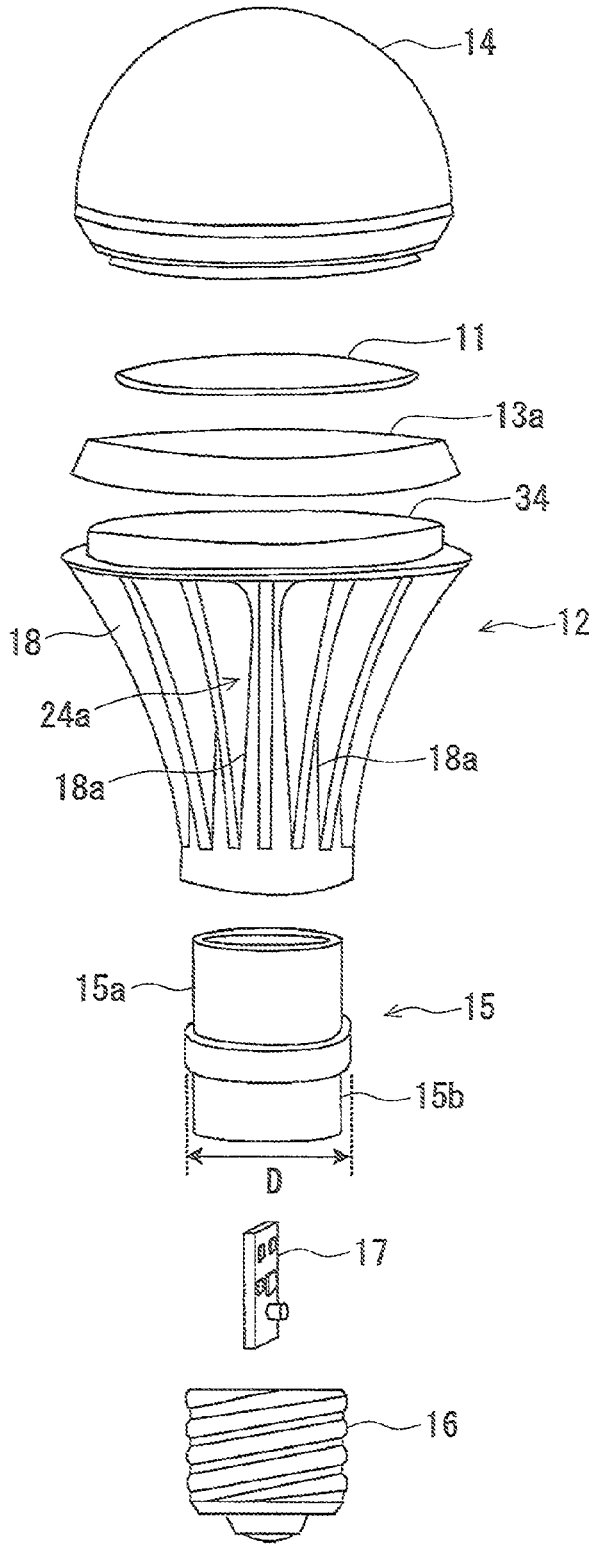
FIG. 7 is an exploded view of the LED bulb according to the third embodiment of the present invention.

FIG. 6 is a front view of an LED bulb according to a third embodiment of the present invention, and FIG. 7 is an exploded view of the LED bulb according to the third embodiment of the present invention.

The difference of the third embodiment from the first embodiment illustrated in FIG. 1 resides in that a tip end of the insulating unit 15 arranged between the heat dissipating unit 12 and the cap 16 is fitted into the heat dissipating unit 12. The like reference numerals are added to portions or members corresponding to those shown in FIG. 1, and repeated explanation thereof is omitted herein.

The LED module 11 on which a plurality of LEDs surface-mounted is integrally attached to a mount surface portion 34 above the heat dissipating unit 12 in a manner contacting the mount surface portion 34. The glove 14 is mounted on the mount surface portion 34 having the LED module 11 mounted thereon in a manner contacting the LED module 11 so as to cover the LED module 11. Radiant light from the LEDs of the LED module 11 is emitted externally from the glove 14.

A reflecting ring 13*a* in the shape of circular ring is fitted to the periphery of the mount surface portion 34, the reflecting ring 13*a* being made of PBT, and an outer circumferential surface thereof is mirror-like finished by vapor deposition or like treatment. The reflecting ring 13*a* operates to reflect the light emitted from the glove 14 in a desired direction.

The heat dissipating fins 18 are planted via base end portions 18*a* thereof to the periphery of the line tube 24*a* provided to the central axis of the heat dissipating unit 12. The base end portions 18*a* of the heat dissipating fins 18 are elementary portions of the heat dissipating fins 18 planted in the line tube 24*a*. Each of the base end portion 18*a* of the heat dissipating fin 18 is formed in a tapered pattern so that the diameter of the line tube 24*a* decreases in a direction of the glove 14. Accordingly, the base end portion 18*a* of the heat dissipating fin 18 on the side of the central axis of the heat dissipating unit 12 is formed so as to be closer to the central axis side than a portion having a maximum diameter D of the insulating unit 15.

The heat dissipating unit 12 is formed with an opening at a lower portion on a side opposite to the glove 14, and a tip end 15*a* of the insulating unit 15 is fitted in this opening. The insulating unit 15 is formed with an inner hollow portion.

According to this structure, when the tip end 15*a* of the insulating unit 15 is fitted in the opening of the heat dissipating unit 12, the base end portions 18*a* of the heat dissipating fins 18 of the heat dissipating unit 12 are positioned closer to the central axis side than the portion having the maximum diameter D of the insulating unit 15, so that the surface area of the heat dissipating fin 18 is increased on the side of the glove 14, thereby improving the heat dissipation efficiency.

The insulating unit 15 has a rear end 15*b* fitted mounted in the cap 16, and the cap 16 has an inner hollow portion 23 into which the lighting circuit 17 for lighting (glowing) the LEDs is incorporated.

According to the third embodiment, the LED module 11, the heat dissipating unit 12, the insulating unit 15 and the cap 16 are arranged in this order, and since the thermal separation is performed by the insulating unit 15, the heat dissipation for the LED module 11 is mostly performed by the heat dissipating unit 12 and the heat dissipation for the lighting circuit 17 is performed by the cap 16, thus improving the heat dissipation characteristics in the entire structure.

Furthermore since the base end portions 18*a* of the heat dissipating fins 18 on the central axis side of the heat dissipating unit 12 are formed so as to be closer to the central axis side than the portion having the maximum diameter D of the insulating unit 15, thus improving the heat dissipation efficiency.

Figure 8A:
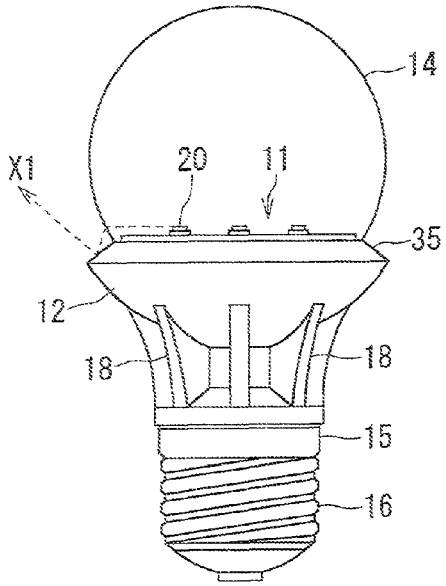
FIGS. 8A and 8B are explanatory views of an LED bulb according to a fourth embodiment of the present invention.
Figure 8B:
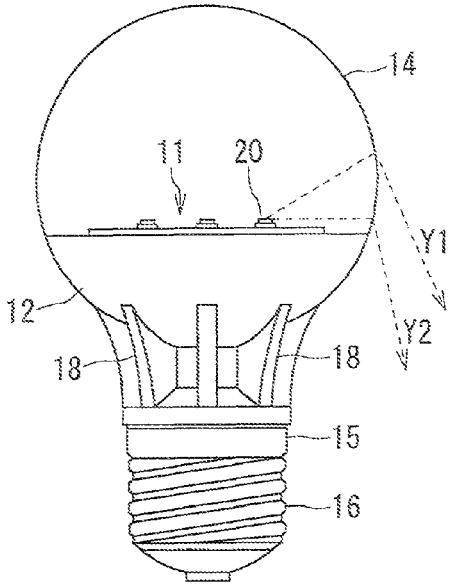

FIG. 8 is an explanatory view of a fourth embodiment of the present invention, in which FIG. 8(*a*) is a front view of an LED bulb according to the fourth embodiment of the present invention, and FIG. 8(*b*) is a front view of the LED bulb before improvement. The difference of the fourth embodiment from the first embodiment illustrated in FIG. 1 resides in that a reflecting plate 35 is arranged in a junction portion between the heat dissipating unit 12 and the glove 14. The reflecting plate 35 is used to reflect, in a direction of the glove, the light radiated from the glove 14 in a direction of the heat dissipating unit. The like reference numerals are added to portions or members corresponding to those shown in FIG. 1, and repeated explanation thereof is omitted herein.

The reflecting plate 35 is, as illustrated in FIG. 8(*a*), arranged in the junction portion between the heat dissipating unit 12 and the glove 14. A part of light radiated from the LED 20 of the LED module 11 is diffused by the glove 14 toward the rear side of the glove, but light radiated in a direction of the heat dissipating unit is, as indicated by a broken-line arrow X1, reflected on the surface of the ring-shaped reflecting plate 35 toward the direction of the glove.

In an arrangement of the LED bulb mounted in the main body of an apparatus, and the reflecting surface of the main body of the apparatus exists on the glove side 14, the reflected light is radiated toward the reflecting surface, thus effectively reducing the light loss. In this regard, in a conventional structure, as illustrated in FIG. 8(*b*), since any reflecting plate 35 does not exist, a larger amount of the light diffused by the glove 14 directly toward the rear side of the glove is hardly radiated to the outside of the apparatus as stray light, thus further increasing the light loss.

According to the fourth embodiment, the light diffused by the glove 14 and passing toward the rear side of the glove can be returned to the glove side, so that light loss is reduced and apparatus efficiency can be increased.

Figure 9A:
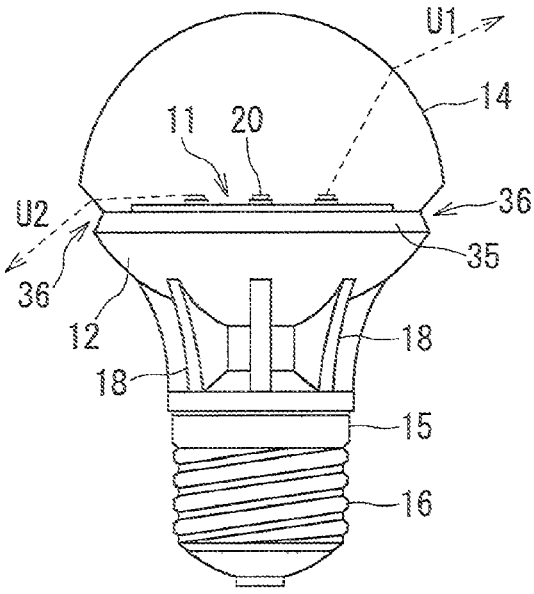
FIGS. 9A and 9B are explanatory views of an LED bulb according to a fifth embodiment of the present invention.
Figure 9B:
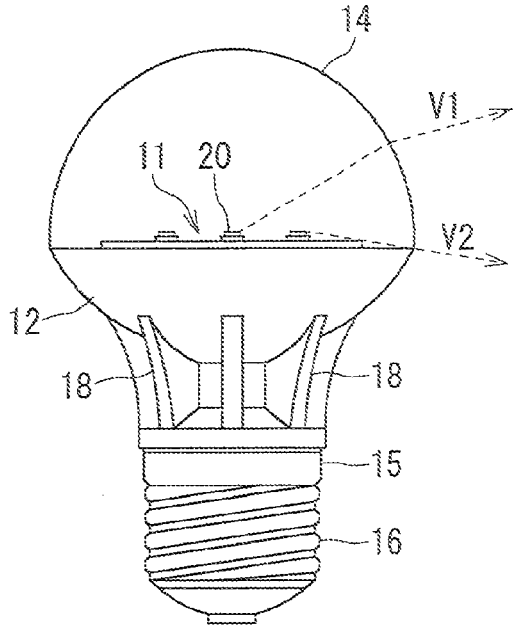

FIG. 9 is an explanatory view representing a fifth embodiment of the present invention, in which FIG. 9(*a*) is a front view of an LED bulb according to the fifth embodiment, and FIG. 9(*b*) is a front view of the LED bulb before improvement of this embodiment.

The difference of the fifth embodiment from the first embodiment illustrated in FIG. 1 resides in that a constricted portion is provided at the junction portion between the heat dissipating unit and the glove. Further, the like reference numerals are added to portions or members corresponding to those shown in FIG. 1, and repeated explanation thereof is omitted herein.

In the junction portion between the heat dissipating unit 12 and the glove 14, a tapered surface is, as illustrated in FIG. 9(*a*), formed to provide a constricted portion 36. That is, the diameter of an open end of the lower side of the glove 14 and the diameter of an upper end of the heat dissipating unit 12 are both gradually restricted so as to provide the constricted portion 36 therebetween. When these diameter reduced portions are joined so as to provide the constricted portion 36, the joined portion provides a diameter smaller than a maximum diameter. Thus, the light U2 of lights (U1 and U2) radiated from the LED 20 of the LED module 11 is radiated from the constricted portion 36 in a direction of a side surface of the glove 14 or in a direction of the heat dissipating unit.

Accordingly, the light distribution of the LED 20 may be raised up on the side surface side and the rear side (the side of the cap) of the glove 14, and hence, the light distribution characteristic of the LED 20 is brought close to that of a filament bulb.

With this regard, in the conventional technology, however, the heat dissipating unit 12 is, as illustrated in FIG. 9(*b*), joined to the glove 14 in the maximum diameter portion, and as a result, a light V2 of lights (V1 and V2) radiated from the LED 20 of the LED module 11 is interrupted by the heat dissipating unit 12 and cannot be radiated to the side surface and the rear side of the glove 14. Accordingly, the light distribution deteriorates in the side surface side and the rear side of the glove 14, and hence, the light distribution characteristic of the LED 20 is not brought close to that of a filament bulb.

According to the fifth embodiment of the present invention, the constricted portion is formed to the junction portion between the heat dissipating unit 12 and the glove 14, and accordingly, the light distribution of the LED 20 is raised in the side surface and the rear side of the glove 14. Thus, the light distribution characteristic of the LED 20 is brought close to that of a filament bulb.

Further, the ring-shaped reflecting plate 35 described in the fourth embodiment may be attached to a tapered surface portion corresponding to the constricted portion 36 on the side of the heat dissipating unit 12. When the reflecting plate 35 is used, the light which is radiated from the side of the constricted portion other than the maximum diameter portion of the glove 14 and which is incident on the tapered surface, is reflected outward on the glove 14 side, so that the light loss can be reduced.

Figure 10:
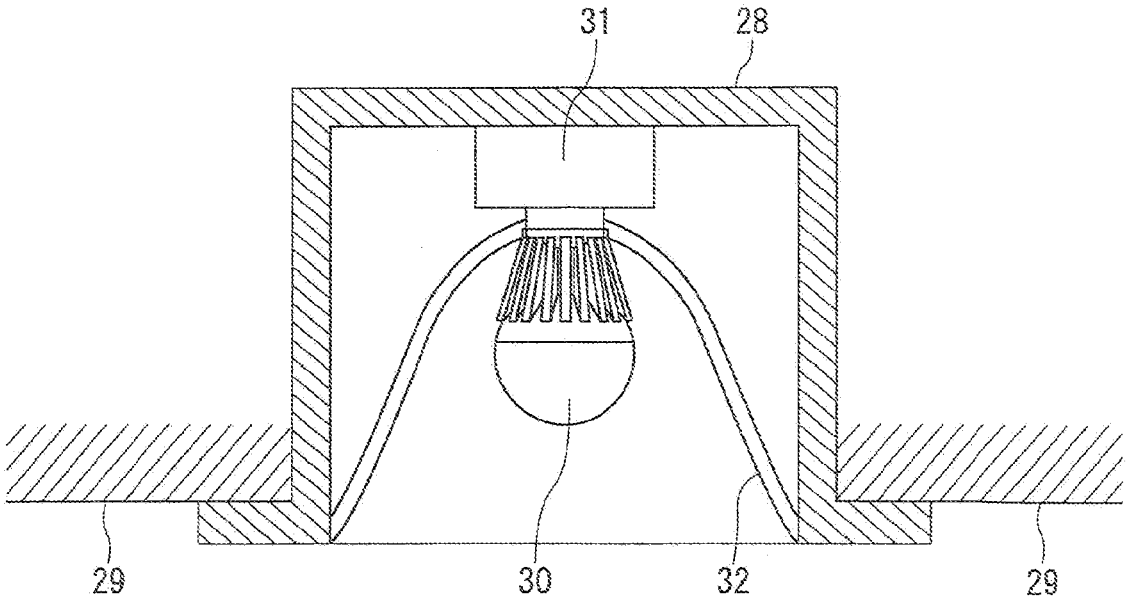
FIG. 10 is an explanatory view of a lighting apparatus according to a sixth embodiment of the present invention.

FIG. 10 is an explanatory view of a lighting apparatus according to a sixth embodiment of the present invention. A lighting apparatus body 28 is mounted to a ceiling 29 in an embedded manner. The lighting apparatus body 28 is provided with a socket 31 used to attach an LED bulb 30 according to any one of the first to fifth embodiments. When the LED bulb 30 is mounted, the LED bulb 30 is screwed into the socket 31. Light from the LED bulb 30 is reflected on a reflecting plate 32 and reflected toward a floor surface.

INDUSTRIAL APPLICABILITY

According to the present invention, since the lighting circuit is arranged in an inner hollow portion of the cap, the distance between the LED module and the lighting circuit is set longer, so that substantially all the heat of the LED module is dissipated through the heat dissipating unit. Thus, it becomes possible to suppress the temperature of the lighting circuit from rising, and hence, to elongate the life of the lighting circuit, which leads to cost saving.

The invention claimed is:

1. An LED bulb comprising:

an LED module;

a plurality of LEDs mounted on a surface of the LED module;

a heat dissipating unit having the LED module mounted thereon and configured to dissipate heat generated by the LEDs, the heat dissipating unit comprising a surface;

a globe-shaped cover covering the LED module and configured to externally pass through radiant light from the LEDs, the globe-shaped cover comprising an outer surface at a side adjacent to the heat dissipating unit;

a cap arranged on a side of the heat dissipating unit opposite to the globe-shaped cover, the cap comprising an inner hollow portion;

a lighting circuit disposed in the inner hollow portion of the cap, wherein the lighting circuit is configured to light the LEDs; and a constricted portion provided at a junction between the heat dissipating unit and the globe-shaped cover and formed by the outer surface of the globe-shaped cover and a surface of a portion of the heat dissipating unit disposed outside of and adjacent to the globe-shaped cover such that both the outer surface of the globe-shaped cover and the surface of the portion of the heat dissipating unit have a reduced diameter compared to at least one other portion of the outer surface of the globe-shaped cover and at least one other portion of the surface of the heat dissipating unit, and wherein a diameter of a widest portion of the heat dissipating unit is greater than a diameter of the portion of the heat dissipating unit disposed outside of the globe-shaped cover and forming the junction.

2. The LED bulb according to claim 1, wherein the LED module is disposed on a side of the globe-shaped cover of the heat dissipating unit such that the LED module thermally contacts a surface of the heat dissipating unit, and the heat dissipating unit is formed with a line-through-hole having a size sufficient for allowing at least a line extending from the LED module and connected to the lighting circuit to pass through the line-through-hole.

3. The LED bulb according to claim 1, wherein the heat dissipating unit comprises heat dissipating fins extending outward in a radial pattern from a center of the heat dissipating unit; and wherein the heat dissipating unit further comprises a portion adjoining the heat dissipating fins and having a convex shape projecting, in the direction of the cap, toward the center of the heat dissipating unit.

4. The LED bulb according to claim 3, wherein an insulating unit having an inner hollow portion is arranged between the heat dissipating unit and the cap, and a groove, with which an end of the heat dissipating fin is engaged, is formed in a tip end of the insulating unit.

5. The LED bulb according to claim 1, wherein the tip end of the insulating unit is fitted into the heat dissipating unit, and a base end of the heat dissipating fin on a center axis side of the heat dissipating unit has a base end portion existing closer to the center axis side than a portion having a maximum outer diameter of the insulating unit.

6. The LED bulb according to claim 1, wherein a reflecting plate for reflecting, in a direction of the globe-shaped cover, light radiated from the globe-shaped cover in a direction of the heat dissipating unit is arranged at the junction between the heat dissipating unit and the globe-shaped cover.

7. A lighting apparatus comprising:

the LED bulb according to claim 1; and a lighting apparatus body having a socket to which the LED bulb is mounted.

8. The LED bulb according to claim 1, wherein the globe-shaped cover has a maximum diameter larger than a maximum diameter of the heat dissipating unit.

* * * * *